US005158925A

United States Patent [19]

Kakuda

[11] Patent Number: 5,158,925

[45] Date of Patent: Oct. 27, 1992

[54] THERMOSENSITIVE RECORDING MATERIAL

[75] Inventor: Tomohisa Kakuda, Numazu, Japan

[73] Assignee: Ricoh Company, Ltd., Tokyo, Japan

[21] Appl. No.: 593,969

[22] Filed: Oct. 9, 1990

[30] Foreign Application Priority Data

Oct. 13, 1989 [JP] Japan ..... 1-267081

[51] Int. Cl.[5] ..... B41M 5/30

[52] U.S. Cl. ..... 503/209; 503/200; 503/208; 503/216; 503/225; 503/226

[58] Field of Search ..... 503/208, 209, 225, 226, 503/200, 216; 427/150–152

[56] References Cited

PUBLICATIONS

Japanese Patent Abstract 59-187890, Oct. 25, 1984.
Japanese Patent Abstract 59-152892, Aug. 31, 1984.
Japanese Patent Abstract 60-210490, Oct. 22, 1985.

*Primary Examiner*—Pamela R. Schwartz
*Attorney, Agent, or Firm*—Oblon, Spivak, McClelland, Maier & Neustadt

[57] ABSTRACT

A thermosensitive recording material comprising a substrate and a thermosensitive coloring layer, formed thereon, which comprises a leuco dye; at least one color developer selected from the group consisting of 1,5-bis(4-hydroxyphenylthio)-3-oxapentane and 1,7-bis(4-hydroxyphenylthio)-3,5-dioxapentane; and an isocyanuric acid derivative of the formula (I):

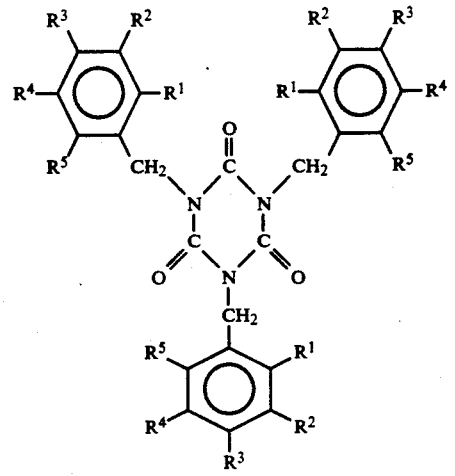

(I)

wherein $R^1$, $R^3$, $R^4$ and $R^5$ independently represent hydrogen or an alkyl group having 1 to 4 carbon atoms, provided that at least either $R^1$ or $R^3$ represents an alkyl group having 1 to 4 carbon atoms; and $R^2$ represents $-C_nH_{2n}OH$ in which n is an integer of 0 to 4.

9 Claims, No Drawings

THERMOSENSITIVE RECORDING MATERIAL

BACKGROUND OF THE INVENTION

1. Field of the Invention

The present invention relates to a thermosensitive recording material and, more particularly, to a thermosensitive recording material comprising a leuco dye which is colorless or light colored at room temperature, serving as a coloring agent, and a color developer capable of inducing color formation in the leuco dye upon application of heat thereto.

2. Discussion of Background

In the field of information recording, as a great variety of information is increasing, many kinds of recording materials are studied, and some are put to practical use to meet the demands for energy-saving and non-pollution.

In particular, a thermosensitive recording material is widely utilized in a variety of fields, such as in the printer for computers and electronic calculators, the recorder for medical measuring instruments, high-speed facsimile apparatus, ticket vending apparatus and thermosensitive copying apparatus because it has the following advantages:

(1) Color development can readily take place in the thermosensitive recording material only by application of heat thereto and clear images are formed thereon without any complicated development process.

(2) The thermosensitive recording material can be manufactured using a relatively simple and compact installation. In addition, the thermosensitive recording material is convenient to handle and the maintenance cost thereof is low.

(3) In general, a sheet of paper is used as a substrate of the thermosensitive recording material. Therefore, not only the cost of the substrate of the recording material can be decreased, but also the touch of the thermosensitive recording material is close to that of plain paper.

The above-mentioned thermosensitive recording material is prepared by coating on a substrate such as a sheet of plain paper, a sheet of synthetic paper and a synthetic resin film a coating solution which contains coloring components capable of causing the coloring reaction under application of heat thereto, and then drying it. When the thermal energy is applied to the thermosensitive recording material with a thermal head or thermal pen, the above coloring components induce the coloring reaction, so that images can be formed on the thermosensitive recording material.

Conventionally, many thermosensitive recording materials are proposed, for example, in Japanese Patent Publications 43-4160 and 45-14039. These conventional thermosensitive recording materials, however, are poor in the coloring thermosensitivity, so that the images with high image density cannot be obtained in the high-speed recording.

To solve the abovementioned problem, the leuco dyes of 3-N-methyl-N-cyclohexylamino-6-methyl-7-anilinofluoran and 3-dibutylamino-6-methyl-7-anilinofluoran are used as the coloring agent with improved coloring sensitivity, as disclosed in Japanese Laid-Open patent application nos. 49-109120 and 59-190891, respectively. In addition, the use of color developers with improved coloring performance, for instance, 1,7-bis(4-hydroxyphenylthio)-3,5-dioxaheptane (Japanese Laid-Open patent application no. 59-106456) and 1,5-bis(4-hydroxyphenylthio)-3-oxapentane (Japanese Laid-Open patent application no. 59-116262) is proposed. In Japanese Laid-Open patent application nos. 61-123584, 61-215087 and 61-242889, the above leuco dyes and color developers are used in combination to realize the high-speed recording with high coloring thermosensitivity.

However, the coloring agent with rapid color development has the drawback that the fade-out readily occurs. This has an adverse influence on the reliability of the thermosensitive recording material.

To prevent the fade-out of the color image, anti-oxidizing agents, such as 1,1,3-tris(2-methyl-4-hydroxy-5-tert-butylphenyl) butane, 1,1,3-tris(2-methyl-4-hydroxy-5-cyclohexylphenyl) butane, 4,4'-thiobis(6-tert-butyl-2-methyl) phenol, 4-benzyloxy-4'-hydroxyphenylsulfone, tetrabromobisphenol A and tetrabromobisphenol S, are usually added to the coloring components. However, these anti-oxidizing agents induce the fogging on the background of the recording material, or the background thereof tends to yellow. Furthermore, the coloring thermosensitivity is decreased when the above anti-oxidizing agent is added to the coloring components.

As disclosed in Japanese Laid-Open patent application nos. 59-187890, 59-152892 and 60-210490, 1,3,5-tris(4-tert-butyl-3-hydroxy-2,6-dimethyl) isocyanuric acid is used together with the coloring components. However, the combinations shown in the above applications do not contribute to the improvement in the high coloring thermosensitivity of the thermosensitive recording material and high-speed recording thereof.

SUMMARY OF THE INVENTION

Accordingly, an object of the present invention is to provide a thermosensitive recording material with high coloring thermosensitivity, capable of yielding colored images with high reliability.

The aforementioned object of the present invention can be achieved by a thermosensitive recording material comprising a substrate and a thermosensitive coloring layer, formed thereon, which comprises (i) a leuco dye serving as a coloring agent; (ii) at least one color developer selected from the group consisting of 1,5-bis(4-hydroxyphenylthio)-3-oxapentane and 1,7-bis(4-hydroxyphenylthio)-3,5-dioxapentane, which is capable of inducing color formation in the above leuco dye when the leuco dye is brought into contact with the color developer and heat is applied thereto; and (iii) an isocyanuric acid derivative represented by the following formula (I):

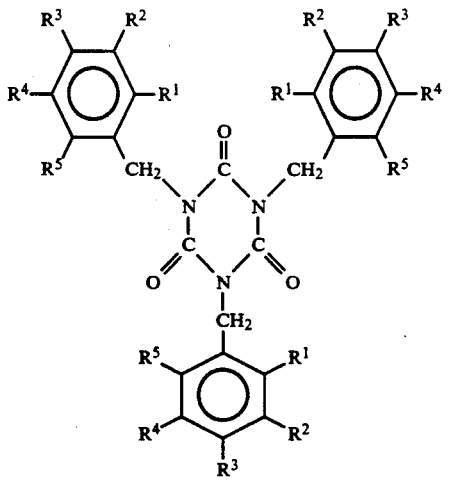

(I)

wherein $R^1$, $R^3$, $R^4$ and $R^5$ independently represent hydrogen or an alkyl group having 1 to 4 carbon atoms, provided that at least either $R^1$ or $R^3$ represents an alkyl group having 1 to 4 carbon atoms; and $R^2$ represents $-C_nH_{2n}OH$ in which n is an integer of 0 to 4.

DESCRIPTION OF THE PREFERRED EMBODIMENTS

Specific examples of the isocyanuric acid derivative of formula (I) to be contained in the thermosensitive coloring layer are as follows:

1,3,5-tris(4-tert-butyl-3-hydroxy-2,6-dimethyl-)isocyanuric acid, 1,3,5-tris(4-tert-butyl-3-hydroxy-2,5-dimethyl-)isocyanuric acid, 1,3,5-tris(4-sec-butyl-3-hydroxy-2,6-dimethyl-)isocyanuric acid, and 1,3,5-tris(3-hydroxybutyl-2,6-dimethyl)isocyanuric acid.

The color developers for use in the present invention, that is, 1,5-bis(4-hydroxyphenylthio)-3-oxapentane and 1,7-bis(4-hydroxyphenylthio)-3-dioxapentane have high sensitivity. When the above color developers are used alone as the color developer in the thermosensitive recording material, however, the obtained images on the recording material tend to fade away while the thermosensitive recording material is stored in a file. To solve this problem, an anti-oxidizing agent is conventionally used as an auxiliary color developer. In particular, bisphenol-type compounds, such as 4,4'-thiobis(6-tert-butyl-2-methyl)phenol and 1,1,3-tris(2-methyl-4-hydroxy-5-cyclohexylphenyl)butane are preferably used as the auxiliary color developer because of its availability. However, 4,4'-thiobis(6-tert-butyl-2-methyl) phenol has the shortcoming that fogging readily occurs on the background of the recording material when the heat is applied to the recording material, and 1,1,3-tris(2-methyl-4-hydroxy-5-cyclohexylphenyl) butane is not entirely satisfactory in the respect of fade-out of images. No other anti-oxidizing agents can solve all the problems of image fading, fogging of the background of the recording material and yellowing of the background thereof.

In the present invention, since the isocyanuric acid derivatives of formula (I) are used together with the color developer, 1,5-bis(4-hydroxyphenylthio)-3-oxapentane or 1,7-bis(4-hydroxyphenylthio)-3,5-dioxapentane, the images formed on the thermosensitive recording material scarcely fade out and the fogging does not occur on the background of the recording material. In addition, no color change and fading due to the affect of nitrogen oxides ($No_x$) takes place, and the preservability of the obtained images is excellent even though the fingerprints are left thereon and oily components attach thereto.

The cause of the above-mentioned effects has not yet logically clarified. No effects can be obtained when 1,3,5-tris(3,5-tert-butyl-4-hydroxy)isocyanuric acid, which is similar to the isocyanuric acid derivatives of formula (I) in structure, is employed, so that it is supposed that the isocyanuric acid derivatives of formula (I) have some multiplier effect when used together with the color developer of 1,5-bis(4-hydroxyphenylthio)-3-oxapentane or 1,7-bis(4-hydroxyphenylthio)-3,5-dioxapentane.

As the leuco dyes for use in the present invention, which are employed alone or in combination, any conventional leuco dyes for use in conventional thermosensitive materials can be employed. For example, triphenylmethane-type leuco compounds, fluoran-type leuco compounds, phenothiazine-type leuco compounds, auramine-type leuco compounds, spiropyran-type leuco compounds and indolinophthalide-type leuco compounds are preferably employed.

Specific examples of those leuco dyes are as follows:

3,3-bis(p-dimethylaminophenyl)-phthalide, 3,3-bis(p-dimethylaminophenyl)-6-dimethylaminophthalide (or Crystal Violet Lactone), 3,3-bis(p-dimethylaminophenyl)-6-diethylaminophthalide, 3,3-bis(p-dimethylaminophenyl)-6-chlorophthalide, 3,3-bis(p-dibutylaminophenyl)-phthalide, 3-cyclohexylamino-6-chlorofluoran, 3-dimethylamino-5,7-dimethylfluoran, 3-(N-methyl-N-isobutylamino)-6-methyl-7-anilinofluoran, 3-(N-ethyl-N-isoamylamino)-6-methyl-7-anilinofluoran, 3-diethylamino-7-chlorofluoran, 3-diethylamino-7-methylfluoran, 3-diethylamino-7,8-benzfluoran, 3-diethylamino-6-methyl-7-chlorofluoran, 3-(N-p-tolyl-N-ethylamino)-6-methyl-7-anilinofluoran, 3-pyrrolidino-6-methyl-7-anilinofluoran, 2-[N-(3'-trifluoromethylphenyl)amino]-6-diethylamino-fluoran, 2-[3,6-bis(diethylamino)-9-(o-chloroanilino)xanthylbenzoic acid lactam], 3-diethylamino-6-methyl-7-(m-trichloromethylanilino)-fluoran, 3-diethylamino-7-(o-chloroanilino)fluoran, 3-dibutylamino-7-(o-chloroanilino)fluoran, 3-N-methyl-N-amylamino-6-methyl-7-anilinofluoran, 3-N-methyl-N-cyclohexylamino-6-methyl-7-anilinofluoran, 3-diethylamino-6-methyl-7-anilinofluoran, 3-diethylamino-6-methyl-7-(2',4'-dimethylanilino)-fluoran, 3-(N,N-diethylamino)-5-methyl-7-(N,N-dibenzylamino) fluoran, Benzoyl leuco methylene blue, 6'-chloro-8'-methoxy-benzoindolino-spiropyran, 6'-bromo-3'-methoxy-benzoindolino-spiropyran, 3-(2'-hydroxy-4'-dimethylaminophenyl)-3-(2'-methoxy-5'-chlorophenyl) phthalide, 3-(2'-hydroxy-4'-dimethylaminophenyl)-3-(2'-methoxy-5'-nitrophenyl) phthalide,
3-(2'-hydroxy-4'-diethylaminophenyl)-3-(2'-methoxy-5'-methylphenyl) phthalide,
3-(2'-methoxy-4'-dimethylaminophenyl)-3-(2'-hydroxy-4'-chloro-5'-methylphenyl) phthalide,
3-morpholino-7-(N-propyl-trifluoromethylanilino)-fluoran,
3-pyrrolidino-7-trifluoromethylanilinofluoran,
3-diethylamino-5-chloro-7-(N-benzyl-trifluoromethyl-anilino) fluoran,
3-pyrrolidino-7-(di-p-chlorophenyl)methylamino-fluoran,
3-diethylamino-5-chloro-7-(α-phenylethylamino)-fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)-fluoran,
3-diethylamino-7-piperidinofluoran,
2-chloro-3-(N-methyltoluidino)-7-(p-n-butylanilino)-fluoran,
3-(N-methyl-N-isopropylamino)-6-methyl-7-anilino-fluoran,
3-dibutylamino-6-methyl-7-anilinofluoran,
3,6-bis(dimethylamino)fluorenespiro-(9,3')-6'-dimethyl-aminophthalide,
3-(N-benzyl-N-cyclohexylamino)-5,6-benzo-7-α-naphthyl-amino-4'-bromofluoran,
3-diethylamino-6-chloro-7-anilinofluoran,
3-N-ethyl-N-(2-ethoxypropyl)amino-6-methyl-7-anilinofluoran
3-N-ethyl-N-tetrahydrofurfurylamino-6-methyl-7-anilinofluoran,
3-diethylamino-6-methyl-7-mesidino-4',5'-benzofluoran,
3-N-methyl-N-isobutyl-6-methyl-7-anilinofluoran,
3-N-ethyl-N-isoamyl-6-methyl-7-anilinofluoran, and
3-dimethylamino-6-methyl-7-(2',4'-dimethylanilino)-fluoran.

In the present invention, the above-mentioned color developers may be used together with other conventional color developers. Those conventional color developers are various electron acceptors, such as phenolic compounds, thiophenolic compounds, thiourea derivatives, and organic acids and metallic salts thereof, which are capable of inducing color formation in the aforementioned leuco dye.

Specific examples of such color developers are as follows:

4,4'-isopropylidenebisphenol,
4,4'-isopropylidenebis(o-methylphenol),
4,4'-sec-butylidenebisphenol,
4,4'-isopropylidenebis(2-tert-butylphenol),
4,4'-cyclohexylidenediphenol,
4,4'-isopropylidenebis(2-chlorophenol),
2,2'-methylenebis(4-methyl-6-tert-butylphenol),
2,2'-methylenebis(4-ethyl-6-tert-butylphenol),
4,4'-butylidenebis(6-tert-butyl-2-methylphenol),
1,1,3-tris(2-methyl-4-hydroxy-5-tert-butylphenyl)butane,
1,1,3-tris(2-methyl-4-hydroxy-5-cyclohexylphenyl)-butane,
4,4'-thiobis(6-tert-butyl-2-methylphenol),
4,4'-diphenolsulfone,
4-isopropoxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate, octyl gallate,
1,3-bis(4-hydroxyphenylthio)-propane,
1,3-bis(4-hydroxyphenylthio)-2-hydroxypropane,
N,N'-diphenylthiourea,
N,N'-di(m-chlorophenyl)thiourea,
salicylanilide,
5-chloro-salicylanilide,
bis(4-hydroxyphenyl)methyl acetate,
bis(4-hydroxyphenyl)benzyl acetate,
1,3-bis(4-hydroxycumyl)benzene,
1,4-bis(4-hydroxycumyl)benzene,
2,4'-diphenolsulfone,
2,2'-diallyl-4,4'-diphenolsulfone,
3,4-dihydroxy-4'-methyldiphenylsulfone,
1-acetyloxy-2-zinc naphthoate,
2-acetyloxy-1-zinc naphthoate,
2-acetyloxy-3-zinc naphthoate,
α,α-bis (4-hydroxyphenyl)-α-methyltoluene,
antipyrine complex of zinc thiocyanate,
tetrabromobisphenol A, and
tetrabromobisphenol S.

To obtain a thermosensitive recording material according to the present invention, a variety of conventional binder agents can be employed for binding the above-mentioned leuco dyes, color developers and isocyanuric acid derivatives serving as an auxiliary color developer to a substrate of the thermosensitive recording material.

Examples of the binder agents are water-soluble polymers; such as polyvinyl alcohol, starch, starch derivatives, cellulose derivatives such as methoxycellulose, hydroxyethylcellulose, carboxymethylcellulose, methyl-cellulose and ethylcellulose, and other water-soluble polymers such as sodium polyacrylate, polyvinyl pyrrolidone, acrylamide-acrylic acid ester copolymer, acrylamide-acrylic acid ester-methacrylic acid terpolymer, alkali salts of styrene-maleic anhydride copolymer, alkali salts of isobutylene-maleic anhydride copolymer, polyacrylamide, sodium alginate, gelatin and casein; emulsions such as polyvinyl acetate, polyurethane, polyacrylic acid ester, polymethacrylic acid ester, vinyl chloride-vinyl acetate copolymer and ethylene-vinyl acetate copolymer; and latexes such as styrene-butadiene copolymer and styrene-butadiene-acrylic acid derivative copolymer.

Further in the present invention, auxiliary additive components which are used in the conventional thermosensitive recording materials, such as a filler, a sensitizer, a lubricant, a surface active agent and other assistants can also be contained in the thermosensitive coloring layer of the thermosensitive recording material according to the present invention.

Examples of the fillers for use in the present invention include finely-divided particles of inorganic fillers such as calcium carbonate, silica, zinc oxide, titanium oxide, aluminum hydroxide, zinc hydroxide, barium sulfate, clay, talc, surface-treated calcium and surface-treated silica; and finely-divided particles of organic fillers such as urea-formaldehyde resin, styrene-methacrylic acid copolymer and polystyrene resin.

The thermosensitive recording material can be prepared by coating a coating solution which contains the above-mentioned components on a substrate, such as a sheet of paper, a sheet of synthetic paper or a plastic film, so that a thermosensitive coloring layer is formed on the substrate. The thermosensitive coloring layer thus formed is then dried and subjected to calendering.

In the present invention, an undercoat layer may be interposed between the substrate and the thermosensitive coloring layer when necessary. In addition, an overcoat layer may be formed on the thermosensitive coloring layer.

It is preferable that the amount ratio of the leuco dye be in the range of 5 to 40 wt. %; that of the color developer, in the range of 20 to 60 wt. %; that of the auxiliary color developer, that is an isocyanuric acid derivative, in the range of 1 to 30 wt. %; and that of other auxiliary additives, in the range of 20 to 60 wt. %, of the total weight of the thermosensitive coloring layer.

As previously mentioned, the thermosensitive recording material according to the present invention is improved in the preservability of the obtained images thereon. According to the present invention, the color degradation of the images on the thermosensitive recording material hardly occurs and the images do not fade away while the recording material is stored by filing for a long time even though the fingerprints or oily components are left on the images. In addition, there is no problem of fogging on the background of the recording material, and the background of the recording material does not tend to yellow due to the affect of $NO_x$.

Other features of this invention will become apparent in the course of the following description of exemplary embodiments, which are given for illustration of the invention and are not intended to be limiting thereof.

EXAMPLE 1

Dispersions A and B were separately prepared by pulverizing and dispersing the following components in a sand mill over a period of 2 to 5 hours.

| | Parts by Weight |
|---|---|
| [Dispersion A] | |
| 3-dibutylamino-6-methyl-7-anilinofluoran | 20 |
| 10% aqueous solution of polyvinyl alcohol | 20 |
| Water | 60 |
| [Dispersion B] | |
| 1, 5-bis(4-hydroxyphenylthio)-3-oxapentane | 20 |
| 1, 3, 5-tris(4-tert-butyl-3-hydroxy-2, 6-dimethyl)isocyanuric acid | 5 |
| Calcium carbonate | 30 |
| 10% aqueous solution of polyvinyl alcohol | 25 |
| Water | 120 |

The above dispersions A and B were mixed at a mixing ratio of 1:8 to prepare a coating solution for the thermosensitive coloring layer.

The thus prepared coating solution was coated on a sheet of high quality paper with a basis weight of 47 g/m$^2$, in a deposition amount of 3.0 g/m$^2$ on a dry basis, and then dried, so that a thermosensitive coloring layer was formed on the substrate. The coated surface of the thermosensitive coloring layer was further subject to calendering, whereby thermosensitive recording material No. 1 according to the present invention was prepared.

EXAMPLE 2

The procedure for the preparation of the thermosensitive recording material No. 1 in Example 1 was repeated except that 1,5-bis(4-hydroxyphenylthio)-3-oxapentane in the dispersion B employed in Example 1 was replaced by 1,7-bis (4-hydroxyphenylthio)-3,5-dioxapentane, so that thermosensitive recording material No. 2 according to the present invention was prepared.

COMPARATIVE EXAMPLE 1

The procedure for the preparation of the thermosensitive recording material No. 1 in Example 1 was repeated except that 1,3,5-tris(4-tert-butyl-3-hydroxy-2,6-dimethyl) isocyanuric acid in the dispersion B employed in Example 1 was replaced by 4,4'-thiobis(6-tert-butyl-2-methyl) phenol, so that comparative thermosensitive recording material No. 1 was prepared.

COMPARATIVE EXAMPLE 2

The procedure for the preparation of the thermosensitive recording material No. 1 in Example 1 was repeated except that 1,3,5-tris(4-tert-butyl-3-hydroxy-2,6-dimethyl) isocyanuric acid in the dispersion B employed in Example 1 was replaced by 1,3,5-tris(3,5-di-tert-butyl-4-hydroxy) isocyanuric acid, so that comparative thermosensitive recording material No. 2 was prepared.

COMPARATIVE EXAMPLE 3

The procedure for the preparation of the thermosensitive recording material No. 1 in Example 1 was repeated except that 1,5-bis(4-hydroxyphenylthio)-3-oxapentane in the dispersion B employed in Example 1 was replaced by benzyl para-hydroxoybenzoate, so that comparative thermosensitive recording material No. 3 was prepared.

The evaluation of the thus obtained thermosensitive recording materials No. 1 and No. 2 according to the present invention and comparative theremosensitive recording materials No. 1 to No. 3 was made by carrying out the following tests.

(1) Dynamic Coloring Sensitivity Test

Each thermosensitive recording material was subjected to a printing test using a commercially available thermal printing test apparatus including a thin-film thermal head, made by Matsushita Electroanic Components Co., Ltd. The printing test was carried out at a printing speed of 20 ms/line and a scanning line density of 8×3.85 dot/mm, with an electric power of 0.45 W/dot applied to the thermal head, and a pulse width changed to 0.2, 0.6 and 1.0 msec, in turn.

The density of the obtained colored images in the recording material was measured by McBeth densitometer RD-914 to evaluate the dynamic coloring thermosensitivity of each recording material.

(2) Preservability Test

Each print sample which was obtained by the above-mentioned printing test at a pulse width of 1.0 msec was allowed to stand at 60° C. for 24 hours, and at 40° C. and 90% RH for 24 hours.

The densities of the colored images and the background of the recording material were measured by McBeth densitometer RD-914 to evaluate the color degradation of the images and the occurrence of the fogging of the background.

(3) Filing Performance Test

Each print sample which was obtained by the above-mentioned printing test was separately interposed between two sheets of paper for plain paper copier (PPC paper) and stored for 3 months.

After 3 months, the density of the colored images in the recording material was measured by McBeth densitometer RD-914 to evaluate the color degradation.

(4) Fingerprints-resistance Test

In the above-mentioned filing performance test, fingerprints were left on part of each print sample.

After 3 months, the color degradation at the portion on which the fingerprints were left in the recording material was visually inspected.

(5) Wall Test

A sample of 5 cm × 5 cm which was not subjected to the printing test was cut from each thermosensitive recording material and the sample was stuck on the wall in an office.

After 3 months, the yellow discoloration of each sample was visually inspected.

The results of the above tests are given in Table 1.

TABLE 1

| | Dynamic Coloring Thermosensitivity | | | | Preservability | | | | Filing Performance | | | |
|---|---|---|---|---|---|---|---|---|---|---|---|---|
| | Image density | | | Back-ground density | 60° C., dry | | 40° C., 90% RH | | Image Density | | Fingerprints-resistance (*) | Wall Test (**) |
| | | | | | Image density | Back-ground | Image density | Back-ground | | | | |
| | 0.2 | 0.6 | 1.0 | | | | | | 0.6 | 1.0 | | |
| Exa. 1 | 0.14 | 0.95 | 1.27 | 0.07 | 1.24 | 0.15 | 1.23 | 0.14 | 0.90 | 1.23 | ○ | ○ |
| Exa. 2 | 0.13 | 0.88 | 1.21 | 0.07 | 1.18 | 0.16 | 0.16 | 0.14 | 0.81 | 1.15 | ○ | ○ |
| Comp. Exa. 1 | 0.15 | 0.93 | 1.24 | 0.10 | 1.23 | 0.24 | 1.23 | 0.18 | 0.87 | 1.22 | Δ | X |
| Comp. Exa. 2 | 0.14 | 0.93 | 1.25 | 0.07 | 0.92 | 0.15 | 0.87 | 0.14 | 0.72 | 0.99 | X | ○ |
| Comp. Exa. 3 | 0.13 | 0.86 | 1.20 | 0.07 | 0.16 | 0.15 | 1.14 | 0.13 | 0.79 | 1.10 | Δ | Δ |

(*) Fingerprints-resistance:
○: Color change scarcely occurred.
Δ: Colored images slightly faded out.
X: Colored images faded out.
(**) Wall test:
○: The recording material did not tend to yellow.
Δ: The recording material did not tend to yellow, but the surface thereof looked powdery.
X: The recording material tended to yellow.

As can be seen from the results in Table 1, the reliability of obtained images is remarkably improved in the thermosensitive recording materials according to the present invention as compared with that in the comparative thermosensitive recording materials.

What is claimed is:

1. A thermosensitive recording material comprising: a substrate, and a thermosensitive coloring layer formed thereon, which comprises (i) a leuco dye serving as a coloring agent, (ii) at least one color developer selected from the group consisting of 1,5-bis(4-hydroxyphenylthio)-3-oxapentane and 1,7-bis(4-hydroxyphenylthio)-3,5-dioxapentane, which is capable of inducing color formation in said leuco dye when said leuco dye is brought into contact with said color developer and heat is applied thereto; and (iii) an isocyanuric acid derivative represented by the formula (I):

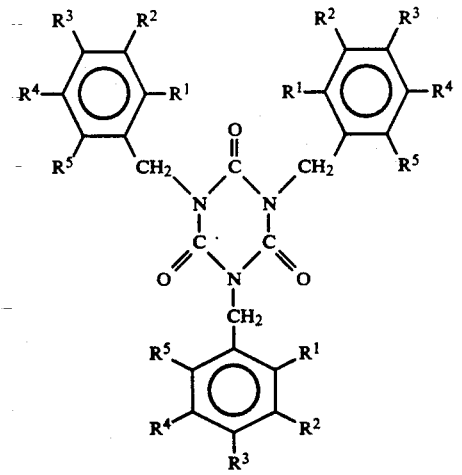

(I)

wherein $R^1$, $R^3$, $R^4$ and $R^5$ independently represent hydrogen or an alkyl group having 1 to 4 carbon atoms, provided that at least either $R^1$ or $R^3$ represents an alkyl group having 1 to 4 carbon atoms; and $R^2$ represents $-C_nH_{2n}OH$ in which n is an integer of 0 to 4.

2. The thermosensitive recording material as claimed in claim 1, wherein said color developer is 1,5-bis(4-hydroxyphenylthio)-3-oxapentane.

3. The thermosensitive recording material as claimed in claim 1, wherein said color developer is 1,7-bis(4-hydroxyphenylthio)-3,5-dioxapentane.

4. The thermosensitive recording material as claimed in claim 1, wherein said isocyanuric acid derivative of formula (I) is selected from the group consisting of
1,3,5-tris(4-tert-butyl-3-hydroxy-2,6-dimethyl-)isocyanuric acid,
1,3,5-tris(4-tert-butyl-3-hydroxy-2,5-dimethyl-)isocyanuric acid,
1,3,5-tris(4-sec-butyl-3-hydroxy-2,6-dimethyl)isocyanuric acid, and
1,3,5-tris(3-hydroxybutyl-2,6-dimethyl)isocyanuric acid.

5. The thermosensitive recording material as claimed in claim 1, wherein said leuco dye is contained in said thermosensitive coloring layer in an amount of 5 to 40 wt. % of the total weight of said thermosensitive coloring layer.

6. The thermosensitive recording material as claimed in claim 1, wherein said color developer is contained in said thermosensitive coloring layer in an amount of 20 to 60 wt. % of the total weight of said thermosensitive coloring layer.

7. The thermosensitive recording material as claimed in claim 1, wherein said isocyanuric acid derivative is contained in said thermosensitive coloring layer in an amount of 1 to 30 wt. % of the total weight of said thermosensitive coloring layer.

8. The thermosensitive recording material as claimed in claim 1, further comprising an undercoat layer which is interposed between said substrate and said thermosensitive coloring layer.

9. The thermosensitive recording material as claimed in claim 1, further comprising an overcoat layer which is formed on said thermosensitive coloring layer.

* * * * *

UNITED STATES PATENT AND TRADEMARK OFFICE

CERTIFICATE OF CORRECTION

PATENT NO. : 5,158,925

DATED : October 27, 1992

INVENTOR(S) : TOMOHISA KAKUDA

It is certified that error appears in the above-identified patent and that said Letters Patent is hereby corrected as shown below:

Column 1, line 58, delete "abovementioned", insert --above-mentioned--.

Column 4, line 64, insert separate line before and after "Benzoyl leuco methylene blue,"

Column 8, line 48, delete "Electroanic", insert --Electronic--.

Signed and Sealed this

Thirtieth Day of November, 1993

*Attest:*

*Attesting Officer*

BRUCE LEHMAN

*Commissioner of Patents and Trademarks*